US011817237B2

(12) United States Patent
Zäuner et al.

(10) Patent No.: US 11,817,237 B2
(45) Date of Patent: Nov. 14, 2023

(54) SURGE PROTECTION DEVICE AND MODULAR SURGE PROTECTION SYSTEM

(71) Applicant: DEHN SE, Neumarkt i.d.OPf. (DE)

(72) Inventors: Edmund Zäuner, Berching/Pollanten (DE); Georg Wittmann, Lauterhofen (DE)

(73) Assignee: DEHN SE, Neumarkt i.d. OPf. (DE)

( * ) Notice: Subject to any disclaimer, the term of this patent is extended or adjusted under 35 U.S.C. 154(b) by 0 days.

(21) Appl. No.: 17/912,104

(22) PCT Filed: Mar. 15, 2021

(86) PCT No.: PCT/EP2021/056562
§ 371 (c)(1),
(2) Date: Sep. 16, 2022

(87) PCT Pub. No.: WO2021/185778
PCT Pub. Date: Sep. 23, 2021

(65) Prior Publication Data

US 2023/0135648 A1 May 4, 2023

(30) Foreign Application Priority Data

Mar. 17, 2020 (DE) ..... 102020107318.6

(51) Int. Cl.
*H01C 7/12* (2006.01)
*H01C 1/022* (2006.01)
(Continued)

(52) U.S. Cl.
CPC ..... *H01C 7/126* (2013.01); *H01C 1/022* (2013.01); *H01H 9/32* (2013.01); *H01H 37/765* (2013.01)

(58) Field of Classification Search
CPC .... H01T 1/12; H01T 1/14; H01T 4/06; H01H 9/32; H01H 37/765; H01C 1/022; H01C 7/126
(Continued)

(56) References Cited

U.S. PATENT DOCUMENTS 11,295,914 B2 4/2022 Hierl et al.
2021/0151957 A1 5/2021 Hirschmann et al.

FOREIGN PATENT DOCUMENTS

DE 8802447 U1 * 2/1989
DE 8802447 U1 2/1989 ..... H01T 1/12
(Continued)

OTHER PUBLICATIONS

Machine Translation of OBO Bettermann German Patent Document DE 8802447 U1 Feb. 23, 1989 (Year: 1989).*
(Continued)

*Primary Examiner* — Kevin J Comber
(74) *Attorney, Agent, or Firm* — Bodner & Bodner, PLLC; Gerald T. Bodner; Christian P. Bodner

(57) ABSTRACT

A surge protection device has at least one disconnecting device (34), at least one actuating device (36), an indicating device (40), and a shaft (38) mounted for rotation between at least a first position and a second position, the at least one actuating device (36) being variable between a first position and a second position. The shaft (38), the indicating device (40) and the actuating device (36) are formed in such a way and the actuating device (36), when in the first position, is fastened to the at least one disconnecting device (34) so as to be preloaded such that when the disconnecting device (34) is triggered, the actuating device (36) is released and triggers the indicating device (40) by means of the shaft (38). Further, a modular surge protection system is described.

20 Claims, 3 Drawing Sheets

(51) Int. Cl.
*H01H 9/32* (2006.01)
*H01H 37/76* (2006.01)

(58) Field of Classification Search
USPC ..... 361/54
See application file for complete search history.

(56) References Cited

FOREIGN PATENT DOCUMENTS

| | | | | |
|---|---|---|---|---|
| DE | 3805890 | A1 | 5/1989 | H01T 1/12 |
| DE | 69904274 | T2 | 8/2003 | H01C 7/12 |
| DE | 102007006617 | B3 | 9/2008 | H01C 1/14 |
| DE | 102007042991 | A1 | 12/2008 | H01C 7/12 |
| DE | 102008026555 | B4 | 8/2016 | H01C 7/12 |
| DE | 102017124219 | A1 | 4/2019 | H01C 7/12 |
| DE | 102018116354 | A1 | 8/2019 | H01T 1/14 |
| DE | 102018125520 | A1 | 4/2020 | H01H 37/72 |
| EP | 0727091 | B1 | 8/1997 | H01C 7/12 |
| EP | 0987803 | A1 | 3/2000 | H01C 7/12 |
| EP | 0987803 | B1 | 12/2002 | H01C 7/12 |
| EP | 1897192 | B1 | 7/2009 | H01T 4/06 |
| EP | 2047487 | B1 | 5/2010 | H01C 7/12 |
| EP | 2897154 | A1 | 7/2015 | H01H 71/10 |
| WO | WO9512893 | A1 | 5/1995 | H01C 7/12 |
| WO | WO2008003532 | A1 | 1/2008 | H01T 4/06 |
| WO | WO2008151861 | A1 | 12/2008 | H01C 7/12 |

OTHER PUBLICATIONS

The Notification Concerning Transmittal of International Preliminary Report on Patentability (Chapter I of the Patent Cooperation Treaty), in English, dated Sep. 29, 2022, which was issued by the International Bureau of WIPO in Applicant's corresponding international PCT application having Serial No. PCT/EP2021/056562, filed on Mar. 15, 2021.

The English translation of the International Preliminary Report on Patentability (Chapter I of the Patent Cooperation Treaty), dated Sep. 20, 2022, which was issued by the International Bureau of WIPO in Applicant's corresponding international PCT application having Serial No. PCT/EP2021/056562, filed on Mar. 15, 2021.

The Written Opinion of the International Searching Authority, in English, dated Jun. 28, 2021, which was issued by the International Bureau of WIPO in Applicant's corresponding international PCT application having Serial No. PCT/EP2021/056562, filed on Mar. 15, 2021.

The International Search Report, in English, dated Jun. 28, 2021, which was issued by the International Bureau of WIPO in Applicant's corresponding international PCT application having Serial No. PCT/EP2021/056562, filed on Mar. 15, 2021.

* cited by examiner

SURGE PROTECTION DEVICE AND MODULAR SURGE PROTECTION SYSTEM

The invention relates to a surge protection device, in particular of type 1, type 2, type 3 or a combination of type 1, 2 and 3, and to a modular surge protection system, in particular of type 1, type 2, type 3 or a combination of type 1, 2 and 3.

Surge protection devices of type 1 are used for protection from entry into a building, e.g. in the event of lightning strikes. Known are surge protection devices of type 1, which are of compact design, i.e. constitute a unit that is installed as a whole, or which are built up from a multipole base part and several plug-in modules.

Surge protection devices of type 2 and type 3 are further arranged within a building and may likewise be of compact or modular design.

Such surge protection devices may be provided with an indicating device, a so-called group display, i.e. a visual indicator regarding the state of the device, as well as a remote signaling switch.

A drawback of such compact surge protection devices, however, is that it is always necessary to replace the entire unit as soon as there is a defect, for example after an overload. Furthermore, known mechanisms for triggering the group display and/or the remote signaling switch are prone to faults and have a low resistance to impact and shock.

Surge protection devices made up of multipole base parts and single-pole plug-in modules usually have the remote signaling indicator mounted in the base part, and the individual plug-in modules have a defect indicator.

It is a drawback here that, in the event of a defect/damage, only the defective plug-in module indicates a failure and is replaced, although a pre-existing defect of the neighboring modules cannot be ruled out and their replacement is also recommended.

It is therefore an object of the invention to provide a surge protection device and a modular surge protection system which can actuate both a group display and/or a remote signaling switch and, at the same time, has a high impact and shock resistance and can be expanded to any desired number of actuating devices.

This object is achieved according to the invention by a surge protection device, in particular a multipole surge protection device, for example of type 1, type 2, type 3 or a combination of types 1, 2 and 3, comprising at least one disconnecting device, in particular one that operates electrothermally, at least one actuating device, an indicating device, and a shaft that is mounted for rotation between at least a first position and a second position. Here, the at least one actuating device is variable between a first position and a second position. Furthermore, the shaft, the indicating device and the actuating device are formed in such a way and the actuating device, when in the first position, is fastened to the at least one disconnecting device so as to be preloaded such that when the disconnecting device is triggered, the actuating device is released and triggers the indicating device by means of the shaft, in particular wherein when the disconnecting device is triggered, the actuating device is released and releases and thereby triggers the indicating device by means of the shaft. Accordingly, the actuating device and the shaft constitute the transfer mechanism by which a disconnection induced by means of the disconnecting device can be transferred to the indicating device. The shaft provides a particularly simple and space-optimized solution for the transfer mechanism here, so that it is possible to provide a particularly compact surge protection device that is easy to manufacture. In addition, this transfer mechanism is extremely resistant to shock and impact, as a result of which a particularly reliable surge protection device can be ensured and almost any number of disconnecting devices can be covered.

To allow a reliable and safe disconnection, the at least one disconnecting device may have a spark gap and the housing may surround the spark gap. The spark gap is, for example, a horn gap.

Disconnecting devices and actuating devices for such disconnecting devices are known from the prior art, for example from DE 10 2018 116 354 A1.

In particular, the actuating device, the shaft and the indicating device work purely mechanically, i.e. there is no electrical actuation of the actuating device, the shaft and the indicating device, whereby a simple and reliable function indication and/or remote signaling indication of the surge protection device can be ensured. Accordingly, the actuating device, the shaft and/or the indicating device need not comprise any electrically conductive materials, so that more cost-effective and easier-to-manufacture materials, such as plastic materials, can be used.

One aspect provides that when the disconnecting device is triggered, the at least one actuating device is released and moves to the second position, wherein the shaft is arranged in relation to the at least one actuating device such that the shaft is in a first position when the at least one actuating device is in the first position, and that the shaft is in a second position when the at least one actuating device is in the second position. Here, the indicating device is held in a locked position by the shaft in the first position and is released in the second position. In this way, a change of state of the indicating device can be effected in a simple manner when there is a change of position of the shaft.

For example, the actuating device and/or the indicating device is/are preloaded against the shaft. The preload provides an immediate actuation and therefore a short response time.

In one embodiment, the surge protection device may include a spring that preloads the actuating device and/or the indicating device.

In particular, the shaft is rotatable between the first position and the second position, preferably about a longitudinal axis of the shaft. The rotary movement allows a particularly space-saving and robust transmission between the actuating device and the indicating device to be ensured.

The fastening of the at least one actuating device to the disconnecting device may be configured such that when a predetermined temperature at the actuating device is exceeded, at least the actuating device becomes at least partly detached from the disconnecting device and releases the actuating device. In this way, it is possible to make use of the generation of heat of the disconnecting device for releasing the actuating device.

In one embodiment, the shaft has at least one engagement surface in the circumferential direction in sections at least in the axial direction. An engagement surface can be engaged by the actuating device and/or the indicating device, i.e., they may, for example, be tensioned against the engagement surface, or a plurality of engagement surfaces may be provided in the axial direction, with one of the engagement surfaces being associated with the actuating device and the other of the engagement surfaces being associated with the indicating device. The engagement surfaces cause the devices engaging them to remain in their initial position, so that no triggering of the indicating device will occur.

In particular, the shaft is formed as a camshaft which includes a plurality of cams spaced apart in the axial direction, with one cam being associated with the at least one actuating device and another cam being associated with the indicating device. Here, the cams each have an engagement surface. The cams present a simple and space-saving option for forming the engagement surfaces.

A further embodiment provides that the actuating device includes an actuating element which is in a first position when the actuating device is in the first position and which is in a second position when the actuating device is in the second position. Here, the actuating element has an actuating area that is configured and arranged to engage the shaft, in particular one of the cams, at least temporarily between the first position and the second position of the actuating element in order to rotate the shaft. The actuating element serves to transmit the disconnection to the shaft.

In particular, the actuating element is rotatably fastened to the disconnecting device so that the transfer of the disconnection to the shaft is effected by a rotation of the actuating element from its first position to the second position.

The actuating element is, for example, preloaded against the shaft, in particular by means of a spring. Due to the preload, a direct actuation and thus a short response time are achieved.

Optionally, the actuating area of the actuating element contacts the shaft only in the first position or only in the second position, as a result of which a tolerance zone, for example a gap, is formed between the actuating element and the shaft before or after disconnection.

Alternatively, the actuating area of the actuating element contacts the shaft constantly, i.e. in the first position, in the intermediate positions and in the second position. This arrangement prevents play between the shaft and the actuating element.

According to one aspect, the indicating device comprises an indicating element, in particular an indicating slider, and a blocking element, in particular a blocking slider, which are each movable, in particular displaceable, between a first position and a second position. The blocking element and the indicating element are arranged here such that, in the first position, the blocking element is preloaded against the shaft, in particular a cam of the shaft, and the indicating element is preloaded against the blocking element. Here, the first position corresponds to a locked position and the second position corresponds to a triggered position. This arrangement of the indicating element and the blocking element in relation to each other allows a simple mechanical chain reaction to release the indicating element and in this way indicate a disconnection.

For example, the indicating element is preloaded against the blocking element, in particular by means of a spring, and/or the blocking element is preloaded against the shaft, in particular a cam of the shaft, in particular by means of a spring. The preload allows an immediate actuation and thus a short response time to be achieved.

The blocking element and the actuating element may be preloaded against different cams of the shaft. This results in a higher variability in the placement of the blocking element and the actuating element relative to each other in the surge protection device.

According to a further aspect, the indicating device includes an indicating area, a first indicating surface that is fixed in the indicating area and in particular has a first color, and a movable second indicating surface, in particular having a second color that is different from the first color. The second indicating surface is movable between a locked position, in particular the first position, in which the second indicating surface covers the first indicating surface, and a tripped position, in particular the second position, in which the second indicating surface is arranged offset from the first indicating surface. In this way, when the movable second indicating surface is moved from its locked position, in particular its first position, to its triggered position, in particular its second position, a change occurs in the indicating area, in particular a color change. In this way, a disconnection that has been effected is visually fed back.

In particular, the second indicating surface is formed on the indicating element, wherein the indicating element is locked in the first position and preloaded toward the second position by a spring, and wherein in the second position the locking of the indicating element is released by the blocking element. This arrangement of the indicating element and the blocking element relative to each other allows the indicating element to be released by a simple mechanical chain reaction, thus allowing a disconnection to be indicated, in particular by a color change.

It may be provided that the axis of rotation of the shaft and the longitudinal axis, in particular the axis of displacement of the indicating element, are parallel to each other. In this manner, the shaft and the indicating element require only a small amount of space laterally of their rotational or longitudinal axes.

In particular, the longitudinal axis, in particular the axis of displacement of the blocking element and/or the longitudinal axis of the actuating element may be substantially orthogonal to the axis of rotation of the shaft and the longitudinal axis, in particular the axis of displacement of the indicating element. In this way, a simple and reliable blocking of the shaft and of the indicating element can be achieved by the actuating element or the blocking element.

The axis of rotation of the shaft and an axis of rotation of the actuating element may optionally be parallel to each other. As a result, a simple transmission can be formed between the actuating element and the shaft while only a small number of components are required.

One embodiment provides that the surge protection device includes a plurality of disconnecting devices, each having at least one actuating device which are adapted to trigger the indicating device independently of each other by means of the shaft. Accordingly, the shaft is a shared shaft for all disconnecting devices, which is associated with the individual actuating devices. Here, a disconnection by at least one disconnecting device is transmitted to the indicating device through the shaft in a logical OR operation. Accordingly, the indicating device constitutes a group display for all disconnecting devices, so that a visual feedback is already given at the indicating device if only one disconnecting device has performed a disconnection. By means of the shaft, any desired number of disconnecting devices can be covered or captured.

For example, the disconnecting devices are arranged at a distance from each other in the axial direction of the shaft. This provides a particularly space-saving arrangement of the disconnecting devices in relation to the shaft.

In particular, each actuating device has its own engagement surface, in particular its own cam of the shaft, associated with it. In this way, independent actuation of the shaft can be effected by the disconnecting devices or, more precisely, by the actuating devices associated with the disconnecting devices.

Furthermore, the object is achieved according to the invention by a modular surge protection system including a base part, in particular a multipole base part, and a surge protection device, in particular a multipole surge protection device, of the type mentioned above, wherein the base part includes a receptacle for the surge protection device. The base part and the surge protection device are thus two separate components, which together constitute the surge protection system. The surge protection device can be inserted into, and removed from, the base, in particular without requiring any tool, as a result of which the surge protection device can be easily replaced, for example after a lightning strike.

According to one aspect, the surge protection system includes a switch that partially projects into the receptacle and is preloaded against the shaft, in particular a cam of the shaft, when the shaft is in the first position and that is actuated when the shaft is in the second position. Thus, in addition to constituting a transfer mechanism between the disconnecting device and the indicating device, the actuating device and the shaft also constitute a transfer mechanism from the disconnecting device to a switch. Generally, the previous discussions regarding the relationship between the at least one disconnecting device, the at least one actuating device, the shaft, and the indicating device also apply to the relationship between the at least one disconnecting device, the at least one actuating device, the shaft, and the switch.

The switch may, for example, be a remote signaling switch which, when actuated, can interrupt or close an electric circuit to trigger a signaling. Thus, in addition to the visual feedback, a further feedback of a disconnection that has been carried out can be provided.

The switch and the actuating element may be preloaded against different cams on the shaft. This results in a higher variability in the placement of the switch and the actuating element relative to each other.

Basically, the release of the indicating element of the indicating device is therefore effected in that the actuating device is triggered by the disconnecting device so that the actuating device, in particular the actuating element of the actuating device, actuates the shaft, for example rotates the shaft or exerts an impulse on the shaft which causes the shaft to rotate.

This causes the blocking element of the indicating device to disengage from the shaft, in particular from the associated cam of the shaft. In this respect, the blocking element then no longer rests against the engagement surface of the associated cam, since the latter has moved together with the shaft, in particular has been rotated. Therefore, the blocking element can now move, in particular in a vertical direction, that is, perpendicular to the axis of the shaft. This is referred to as the release of the blocking element.

The (vertical) movement of the blocking element in turn ensures that the blocking element no longer blocks the indicating element of the indicating device, which is mechanically preloaded, so that the indicating element can move in the horizontal direction, i.e. perpendicular to the direction of movement of the blocking element and accordingly parallel to the axis of the shaft. This is also referred to as the release of the indicating element.

Accordingly, a release mechanism is provided by means of which the indicating element is released so that the indicating element can move to indicate a disconnection. In this regard, the release mechanism comprises the active chain which comprises the actuating device and the shaft and which leads to the release of the blocking element that blocks the indicating element, so that the indicating element can move.

The above-described advantages and features of the surge protection device according to the invention apply equally to the surge protection system and vice versa.

Further advantages and features of the invention will be apparent from the description below and from the accompanying drawings, to which reference is made and in which.

Figure 1:
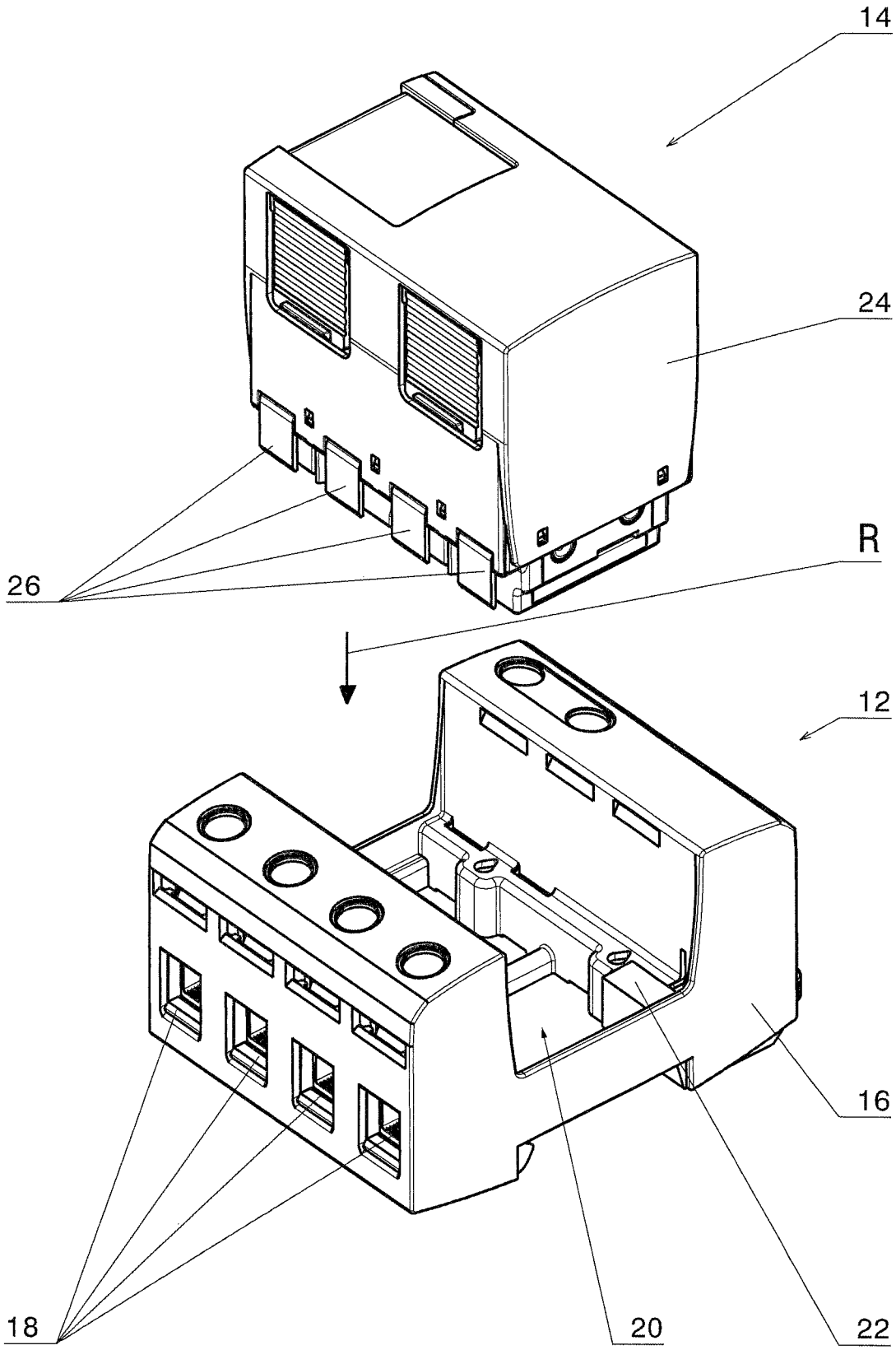
FIG. 1 shows a perspective view of a modular surge protection system according to the invention with a surge protection device according to the invention.

FIG. 1 illustrates a modular surge protection system 10 which includes a multipole base part 12 and a multipole surge protection device 14.

The surge protection system 10 is modular to the effect that the surge protection device 14 can be removed from the base part 12 and replaced, for example after a lightning strike.

The base part 12 has a housing 16 with terminals 18 and a receptacle 20.

The surge protection device 14 can be inserted into the receptacle 20 in an insertion direction R and be held, thereby making the surge protection system 10 ready for operation.

A remote signaling switch 22 (RS switch) is provided within the housing 16.

The surge protection device 14 includes a device housing 24 and contacts 26 that are not covered by the device housing 24. When the surge protection device 14 is inserted in the receptacle 20, the surge protection device 14 is electrically connected to the terminals 18 of the base part 12 by means of the contacts 26.

Figure 2:
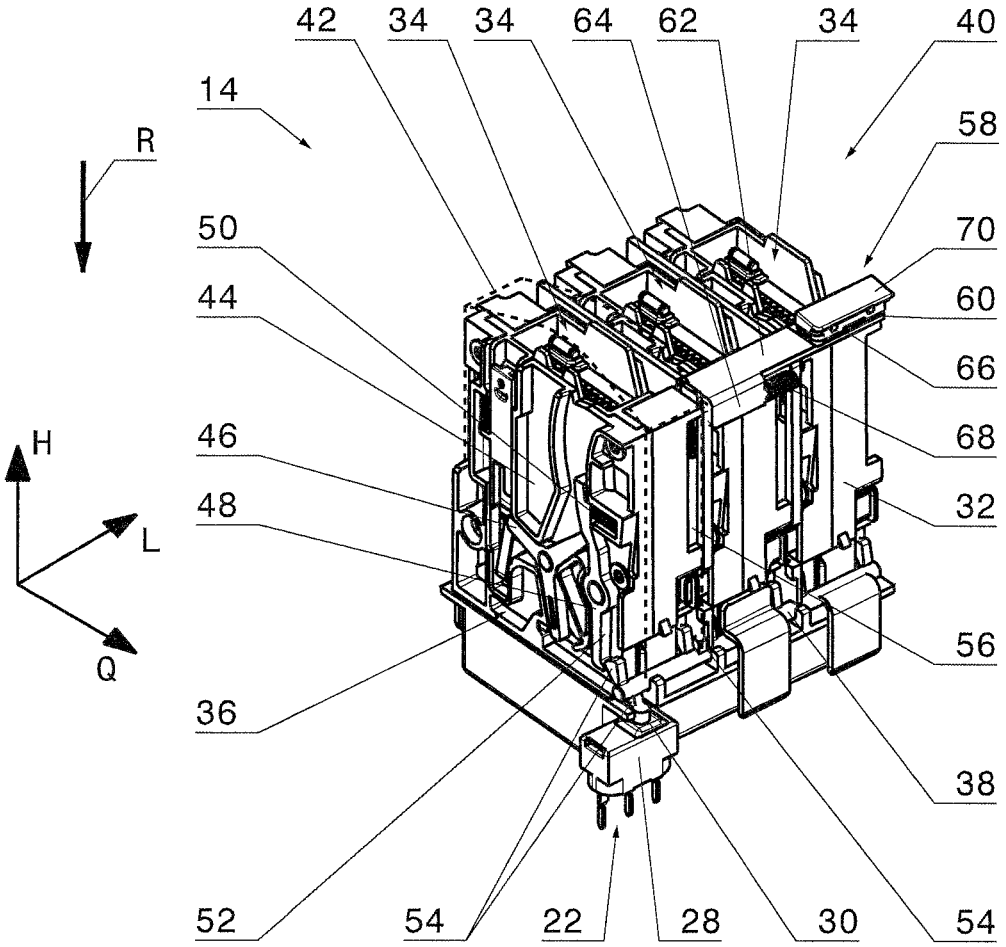
FIG. 2 shows an inner portion of the surge protection device of the surge protection system according to FIG. 1.

FIG. 2 shows the surge protection device 14 without the device housing 24 for greater clarity, so that the interior of the surge protection device 14 can be seen. Furthermore, the remote signaling switch 22 of the base part 12 is indicated by way of example.

The remote signaling switch 22 comprises a microswitch 28 having a trigger 30 that can be integrated in a building services control system, a switch cabinet control system, or the like, to indicate the status of the surge protection system 10 or the surge protection device 14.

The surge protection device 14 has a frame 32, a plurality of disconnecting devices 34, in this case three, a plurality of actuating devices 36 that are each associated with a disconnecting device 34, a shaft 38, and an indicating device 40.

It is, of course, also conceivable that exactly one, two or more than three disconnecting devices 34 are provided.

The frame 32 serves in particular as a bottom of the surge protection device 14, to which the contacts 26, the disconnecting devices 34, the actuating devices 36, the shaft 38 and the indicating device 40 are fastened or at which they are guided.

The frame 32 comes into direct contact with the bottom of the receptacle 20 and is formed to be complementary to the receptacle 20.

The disconnecting devices 34 are each received between two support-like structures of the frame 32. The support-like structures extend in the upward direction H of the surge protection device 14 or the surge protection system 10.

In the context of this invention, the upward direction H of the surge protection device 14 or the surge protection system 10 is intended to be opposite to the insertion direction R, in which the surge protection device 14 is inserted into the base part 12. This is for illustrative purposes only and corresponds to the orientation of the Figures. However, in the orientation in which the surge protection system 10 is usually mounted, the upward direction H is horizontal.

The directional indications "up" and "down" likewise refer to the orientations shown in the Figures.

Perpendicular to the upward direction H, the surge protection device 14 has a transverse direction Q and a longitudinal direction L, which correspond to the directions of the shorter and the longer side edges, respectively, of the surge protection device 14.

The disconnecting devices 34 each include a housing 42 that is indicated by dashed lines in FIG. 2 for one of the disconnecting devices 34.

Also arranged in each of the housings 42 is at least one overvoltage-limiting component, such as a spark gap or a varistor.

In this exemplary embodiment of the disconnecting devices 34, a spark gap (not shown), for example a horn gap, is formed in each of the housings 42.

The disconnecting devices 34, or more precisely the housings 42, extend mainly in the upward direction H and the transverse direction Q and are arranged in alignment one behind the other in the longitudinal direction L.

The actuating devices 36 are arranged in front of the respective disconnecting devices 34, as viewed in the longitudinal direction L, and are fastened to the frame 32 and/or to the disconnecting device 34 assigned thereto.

The actuating devices 36 each comprise a base plate 44 that extends substantially in the upward direction H and the transverse direction Q. In the longitudinal direction L, the base plates 44 and the disconnecting devices 34 or the housings 42 are arranged in alignment one behind the other.

In addition, the actuating devices 36 each include a triggering element 46 and an actuating element 48 which are mounted at the base plate 44 for rotational movement. The axes of rotation of the two elements 46, 48 may be parallel to each other and point in the longitudinal direction L.

The triggering element 46 has, for example, a star-like shape and forms a stop for the actuating element 48 in the first position of the actuating device 36 as shown in FIG. 2.

The triggering element 46 is fixed in place on a component of the respective disconnecting device 34 which locks the triggering element 46 in the first position shown.

For example, this component is temperature-sensitive and releases the triggering element 46 when a specific temperature is exceeded.

In another embodiment, the triggering element 46 may also cooperate with the respective disconnecting device 34 in other ways.

The actuating element 48 is shaped, for example, in a lever-like manner and, in the first position of the actuating device 36 as shown in FIG. 2, is in a first position that corresponds to an initial position.

In the first position, the actuating element 48 is preloaded against the triggering element 46 by a spring 50 that engages the actuating element 48 in an upper portion, with the actuating element 48 being supported against the triggering element 46.

The spring 50 may be a spiral spring, for example.

In a lower portion, the actuating element 48 has an actuating portion 52 that engages the shaft 38 at least at times.

In a lower part of the surge protection device 14, the shaft 38 is mounted for rotation such that it can assume a first position and a second position. The axis of rotation of the shaft 38 is oriented in the longitudinal direction L here and may be parallel to the axes of rotation of the two elements 46, 48.

The shaft 38 is in the form of a camshaft here and has a plurality of spaced apart cams 54 in the axial direction, each of which has an engagement surface.

Figure 3:
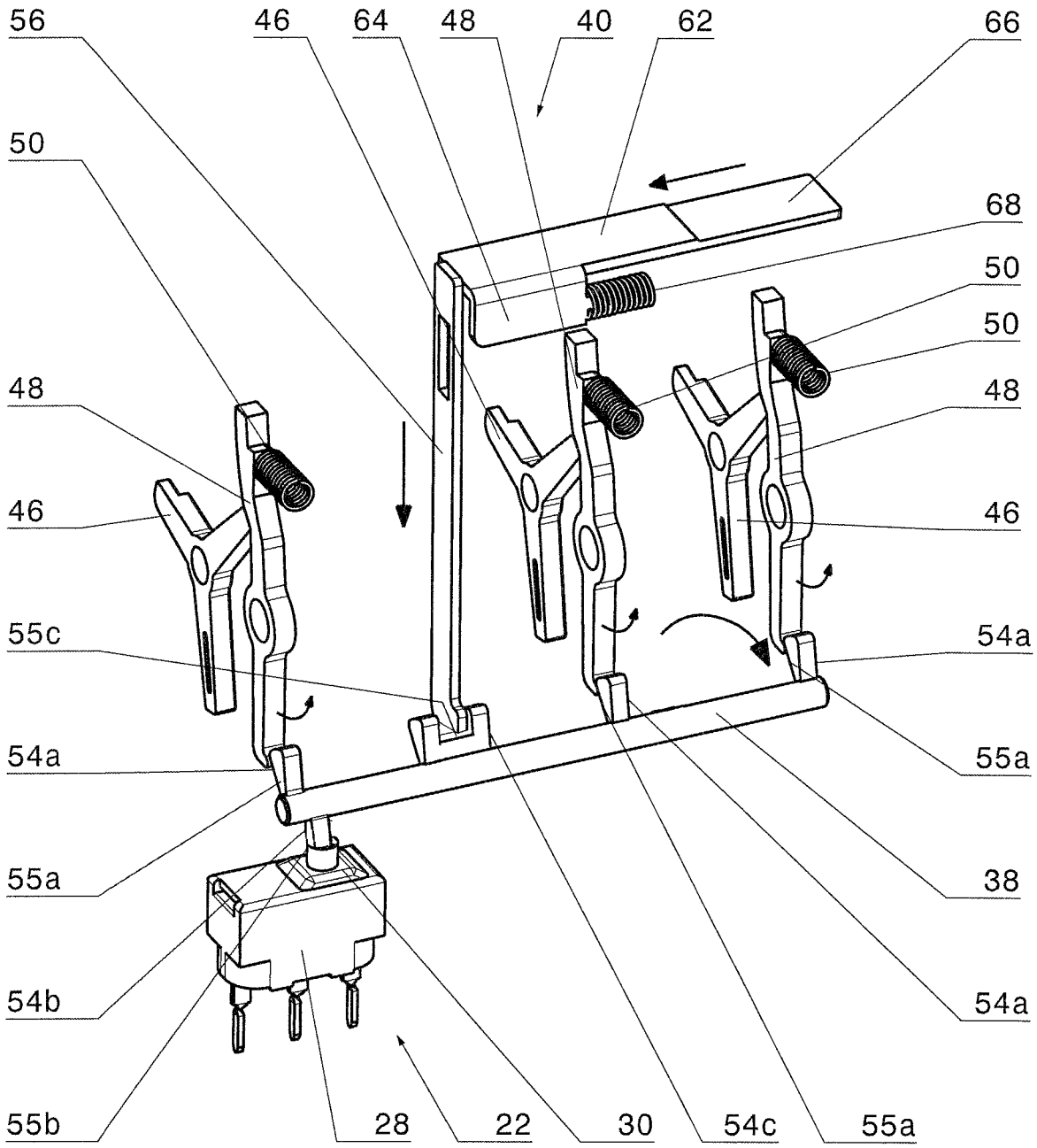
FIG. 3 shows a detailed view of individual components of the surge protection device according to FIGS. 1 and 2.

The shaft 38 has different types of cams 54, which can be seen clearly in FIG. 3.

A first type of cam 54*a* is assigned to each of the individual actuating devices 36 or, more precisely, the individual actuating elements 48.

Here, the engagement surface 55*a* of the cams 54*a* is oriented in the circumferential direction of the shaft 38. In particular, the engagement surface 55*a* extends substantially in the radial and axial directions of the shaft 38.

The engagement surface 55*a* is provided, for example, on a side of the cams 54*a* opposite the actuating portion 52 of the actuating element 48.

A second type of cam 54*b* is assigned to the remote signaling switch 22 and has smaller dimensions, in particular in the radial direction, than the first type of cam 54*a*.

For example, the cam 54*b* may also be shaped only as a fairly small bulge.

Here, the engagement surface 55*b* of the cam 54*b* is oriented in the radial direction of the shaft 38. In particular, the engagement surface 55*b* extends in the circumferential and axial directions of the shaft.

The engagement surface 55*b* is provided, for example, on the side of the cam 54*b* opposite the remote signaling switch 22, against which the remote signaling switch 22 or, more specifically, the trigger 30 is preloaded.

A third type of cam 54*c* is assigned to the indicating device 40 and has smaller dimensions, in particular in the radial direction, than the first type of cam 54*a*.

For example, the cam 54*c* may also be shaped only as a fairly small bulge.

Here, the engagement surface 55*c* of the cam 54*c* is oriented in the radial direction of the shaft 38. In particular, the engagement surface 55*c* extends in the circumferential and axial directions of the shaft 38.

Part of the indicating device 40 is provided at the top of the surge protection device 14, i.e. above the disconnecting devices 34, and part of it is provided within the frame 32.

The indicating device 40 includes a blocking element 56, an indicating area 58, a base plate 60, and an indicating element 62 that is movable in relation to the base plate 60.

The blocking element 56 is mounted for vertical displacement within the frame 32 relative to the upward direction H and can assume a first position and a second position. Thus, the blocking element 56 is a blocking slider.

In the first position shown in FIG. 2, the blocking element 56 is supported substantially vertically on the engagement surface 55*c* of the cam 54*c* of the shaft 38 in the radial direction of the shaft 38. To this end, the engagement surface is provided, for example, on a side of the cam 54*c* that is arranged in the radial direction of the shaft 38 and is opposite the blocking element 56.

Optionally, the blocking element 56 may be preloaded against the shaft 38 and thus toward the second position by means of a spring.

On the upper side of the support-like structures of the frame 32, the indicating element 62 is mounted for horizontal displacement in relation to the longitudinal direction L and can assume a locked position and a tripped position. Accordingly, the indicating element 62 is an indicating slider.

The indicating element 62 includes a guide section 64 and, in the indicating area 58, a main section 66. The guide section 64 and the main section 66 are provided at opposite ends of the indicating element 62.

The guide section 64 is placed on the support-like structures of the frame 32 like a carriage.

A spring 68, which may be a spiral spring, for example, engages the indicating element 62 or, more precisely, the guide section 64.

The device housing 24 of the surge protection device 14 may additionally include a viewing window 70 in the indicating area 58, which allows a view onto the indicating area 58.

In the exemplary embodiment shown, the base plate 60 is formed by the top side of one of the support-like structures of the frame 32. This means that the base plate 60 is part of the support-like structures of the frame 32.

The portion of the base plate 60 in the indicating area 58 forms a fixed first indicating surface. The first indicating surface is red in color, for example.

In the indicating area 58, the main section 66 of the indicating element 62 has a second indicating surface, which is thus also movable.

The second indicating surface is provided at the end of the main section 66 that faces away from the guide section 64.

The second indicating surface, in particular the entire indicating element 62, is green in color.

In the locked position shown in FIG. 2, the second indicating surface of the indicating element 62 covers the first indicating surface of the base plate 60 so that the green, second indicating surface can be seen through the viewing window 70.

In addition, the indicating element 62 is preloaded against the blocking element 56 and thus toward the tripped position by the spring 68.

Altogether, in the surge protection system 10, the actuating device 36 is operatively coupled to the indicating device 34 and the remote signaling switch 22 by means of the shaft 38. Here, a respective cam 54*a* is assigned to the actuating devices 36 or, more precisely, to the actuating elements 48, a cam 54*b* is assigned to the remote signaling switch 22 or, more precisely, to the trigger 30, and a cam 54*c* is assigned to the indicating device 40 or, more precisely, to the blocking element 56.

In FIG. 3, the actuating devices 36, the shaft 38, the indicating device 40 and the remote signaling switch 22 are depicted without the disconnecting devices 34, the base plates 44 and the frame 32.

With reference to FIGS. 2 and 3, the change of display by the indicating device 40 and the triggering of the remote signaling switch 22 upon disconnection by one of the disconnecting devices 34 will be discussed.

In the situation shown in FIGS. 2 and 3, the triggering elements 46 and the actuating elements 48 of the actuating devices 36 are in the first position, the shaft 38 is in the first position, and the blocking element 56 and the indicating element 62 are in the locked position.

The actuating elements 48 of the actuating devices 36 are each preloaded against the associated triggering element 46 by the respective spring 50 here, the blocking element 56 is supported—optionally assisted by spring force—on the cam 54*c* of the shaft 38, and the indicating element 62 is preloaded against the blocking element 56 in the longitudinal direction L by the spring 68. In this state, only the green, second indicating surface can be seen through the viewing window 70.

This is the operating condition of the surge protection device 14 when all of the disconnecting devices 34 are operational.

In the case of use of the surge protection system 10 or the surge protection device 14, a lightning-induced or other overvoltage is dissipated by at least one overvoltage-limiting component, such as a spark gap and/or a varistor.

In the event of particularly large, high-energy overvoltages, one or more of the overvoltage-limiting components may lose its/their functionality and is/are then safely disconnected by the respective disconnecting devices 34, which is communicated by the indicating device 40 and the remote signaling switch 22. To this end, both the indicating device 40 and the remote signaling switch 22 are triggered.

In the event of an overload of an overvoltage-limiting component, e.g. the spark gap or the varistor, a large amount of heat is generated, which is detected by the disconnecting device 34 by means of a temperature-sensitive component or by which the disconnecting device 34 is triggered. The disconnecting device 34 then disconnects the overloaded voltage-limiting component.

As soon as one of the temperature-sensitive components in one or more of the disconnecting device(s) 34 reaches a predetermined temperature, which in this case is determined by the melting point of the temperature-sensitive component, the temperature-sensitive component will disintegrate so that the triggering element 46 is no longer locked in place.

Once the triggering element 46 has been disengaged from the temperature-sensitive component, it is no longer capable of holding the actuating element 48 in the locked position against the spring force of the spring 50.

The triggering element 46 and the actuating element 48 will then rotate counterclockwise until they are stopped at one or more stop points of the base plate 44. The triggering element 46 and the actuating element 48 are then each in their second position.

It is, of course, also conceivable that the actuating device 36 or, more precisely, the triggering element 46 is released in some other way.

During the rotation of the actuating element 48 or while already in the first position, the actuating portion 52 of the actuating element 48 rests against the engagement surface of the cam 54*a* of the shaft 38 assigned to the actuating element 48. When the actuating element 48 is rotated, the actuating element 48 engages the cams 54*a* in the circumferential direction and generates a torque on the shaft 38, thereby rotating the shaft 38 in a clockwise direction, in particular to its second position.

The rotation of the shaft 38 to its second position causes the cam 54*b*, which is associated with the remote signaling switch 22 and against which the trigger 30 is preloaded essentially in the radial direction of the shaft 38, to move away from the trigger 30 in the circumferential direction of the shaft 38.

This causes the trigger 30 to be released, for example when the second position of the shaft 38 is reached, and to move, in particular in a spring-preloaded manner, toward the shaft in the radial direction, whereby the microswitch 28 is actuated.

Because of the actuation of the remote signaling switch 22, a circuit is broken or closed, causing the remote signaling to occur.

It is also conceivable that rotation of the shaft 38 to its second position causes the cam 54*b* to move against the trigger 30 of the remote signaling switch 22, whereby the latter is retracted to some extent, thus actuating the microswitch 28.

When the shaft 38 is rotated to its second position, the cam 54*c*, which is assigned to the indicating device 40 and on which the blocking element 56 is supported substantially vertically in the radial direction of the shaft 38, is at the same time moved in the circumferential direction of the shaft 38 such that the cam 54*c* moves away from the blocking element 56.

As a result, the blocking element 56 can no longer be supported on the cam 54*c* as from a certain point in time, for example when the second position of the shaft 38 is reached. From this point in time, the blocking element 56 is released and is displaced—optionally assisted by spring force—downward to its tripped position along the upward direction H.

The movement of the blocking element 56 removes the locking of the indicating element 62 in the longitudinal direction L. The indicating element 62 then moves—driven by the spring 68—in the longitudinal direction L to its tripped position.

In the tripped position, the second indicating surface or the main section 66 is offset from the first indicating surface or the base plate 60 so that the first indicating surface is no longer covered.

In other words, only the first indicating surface is still located in the indicating area 58, so that a red surface is visible through the viewing window 70.

The red, first indicating surface indicates a defect in at least one of the disconnecting devices 34, so that the surge protection device 14 has to be replaced.

In this way, both the remote signaling switch 22 and the indicating device 40 are actuated as soon as one of the disconnecting devices 34 is defective. The shaft 38 thus serves here as a logical OR operation between the disconnecting devices 34 or the associated actuating devices 36, on the one hand, and the remote signaling switch 22 and the indicating device 40, on the other hand. The remote signaling switch 22 thus constitutes a group annunciator, and the indicating device 40 constitutes a group display.

The operative processes downstream of the disconnecting device 34 or as from the triggering element 46 are purely mechanical and therefore considerably more reliable than other transfer mechanisms.

Here, both the indicating device 40 and the remote signaling switch 22 are triggered and actuated by the same shaft 38, so that cases in which the indications do not coincide are avoided.

The invention claimed is:

1. A surge protection device comprising at least one disconnecting device, at least one actuating device, an indicating device, and a shaft mounted for rotation between at least a first shaft position and a second shaft position, wherein the at least one actuating device is variable between a first actuating position and a second actuating position, wherein the shaft, the indicating device and the actuating device are formed in such a way and the actuating device, when in the first actuating position, is fastened to the at least one disconnecting device so as to be preloaded such that when the disconnecting device is triggered, the actuating device is released and triggers the indicating device by means of the shaft, wherein, when the disconnecting device is triggered, the actuating device becomes at least partly detached from the disconnection device.

2. The surge protection device according to claim 1, characterized in that when the disconnecting device is triggered, the at least one actuating device is released and moves to the second actuating position, wherein the shaft is arranged in relation to the at least one actuating device such that the shaft is in the first shaft position when the at least one actuating device is in the first actuating position, and that the shaft is in the second shaft position when the at least one actuating device is in the second actuating position, wherein the indicating device is held in an untriggered position by the shaft in the first shaft position and is released in the second shaft position.

3. The surge protection device according to claim 1, characterized in that the fastening of the at least one actuating device to the disconnecting device is configured such that when a predetermined temperature at the actuating device is exceeded, at least the actuating device becomes at least partly detached from the disconnecting device and releases the actuating device.

4. The surge protection device according to claim 1, characterized in that the shaft has at least one engagement surface in a circumferential direction in sections at least in an axial direction.

5. The surge protection device of claim 4, wherein the shaft is formed as a camshaft which includes a plurality of cams spaced apart in the axial direction, with one cam being associated with the at least one actuating device and another cam being associated with the indicating device.

6. The surge protection device according to claim 1, characterized in that the actuating device includes an actuating element which is in a first position when the actuating device is in the first actuating position and which is in a second position when the actuating device is in the second actuating position, wherein the actuating element has an actuating portion that is configured and arranged to engage the shaft at least temporarily between the first position and the second position of the actuating element in order to rotate the shaft.

7. The surge protection device of claim 6, wherein the actuating portion of the actuating element is configured and arranged to engage one of a plurality of cams at least temporarily between the first position and the second position of the actuating element in order to rotate the shaft.

8. The surge protection device according to claim 1, characterized in that the indicating device comprises an indicating element and a blocking element, which are each movable between a first position and a second position, the blocking element and the indicating element being arranged such that the blocking element when in the first position is preloaded against the shaft and the indicating element is preloaded against the blocking element.

9. The surge protection device of claim 8, wherein the blocking element when in the first position is preloaded against a cam of the shaft.

10. The surge protection device according to claim 8, characterized in that an axis of rotation of the shaft and a longitudinal axis of the indicating element are parallel to each other.

11. The surge protection device of claim 10, wherein the longitudinal axis of the indicating element is an axis of displacement of the indicating element.

12. The surge protection device of claim 11, wherein an axis of displacement of the blocking element and/or a longitudinal axis of the actuating element are substantially orthogonal to the axis of rotation of the shaft and the longitudinal axis of the indicating element.

13. The surge protection device according to claim 1, characterized in that the indicating device includes an indicating area, a first indicating surface that is fixed in the indicating area, and a movable second indicating surface, the second indicating surface being movable between a locked position in which the second indicating surface covers the first indicating surface, and a tripped position in which the second indicating surface is arranged offset from the first indicating surface.

14. The surge protection device according to claim 13, characterized in that the second indicating surface is formed on the indicating element, wherein the indicating element is locked in the first position and preloaded toward the second position by a spring, wherein in the second position the locking of the indicating element is released by the blocking element.

15. The surge protection device according to claim 1, characterized in that an axis of rotation of the shaft and an axis of rotation of an actuating element are parallel to each other.

16. The surge protection device according to claim 1, characterized in that the surge protection device includes a plurality of disconnecting devices, each having at least one actuating device which are adapted to trigger the indicating device independently of each other by means of the shaft.

17. A modular surge protection system comprising a base part and the surge protection device according to claim 16, wherein the base part includes a receptacle for the surge protection device.

18. The modular surge protection system according to claim 17, characterized in that the surge protection system includes a switch that partially projects into the receptacle and is preloaded against the shaft, when the shaft is in the first shaft position and that is actuated when the shaft is in the second shaft position.

19. The surge protection device of claim 18, wherein the switch is preloaded against a cam of the shaft.

20. The surge protection device according to claim 1, wherein when the disconnecting device is triggered, the actuating device is released and releases and thereby triggers the indicating device by means of the shaft.

* * * * *